US005402987A

United States Patent [19]

Duyck et al.

[11] Patent Number: 5,402,987

[45] Date of Patent: Apr. 4, 1995

[54] COMPOSITE ROAD SAFETY SLIP RAILS MADE FROM METAL AND REINFORCED WOOD

[76] Inventors: Daniel Duyck, 3 Chemin de la Plaine, 14370 Chicheboville; Jacques de Maussion, Domaine de Tertu, 61160 Trun, both of France

[21] Appl. No.: 55,528

[22] Filed: Apr. 29, 1993

[30] Foreign Application Priority Data

Apr. 30, 1992 [FR] France ..... 92 05540

[51] Int. Cl.[6] ..... E01F 15/00

[52] U.S. Cl. ..... 256/13.1; 256/19; 256/64; 256/65

[58] Field of Search ..... 256/13.1, 19, 63, 64, 256/65, 68, 69, DIG. 4

[56] References Cited

U.S. PATENT DOCUMENTS

| | | | |
|---|---|---|---|
| 3,776,520 | 12/1973 | Charles et al. | 256/13.1 |
| 4,722,513 | 2/1988 | Gaillard et al. | 256/65 |
| 4,946,138 | 8/1990 | Galliard et al. | 256/65 |
| 4,982,931 | 1/1991 | Pomero | 256/19 |
| 5,169,127 | 12/1992 | Eynard | 256/13.1 |

FOREIGN PATENT DOCUMENTS

| | | | |
|---|---|---|---|
| 0343091 | 11/1989 | European Pat. Off. | 256/13.1 |
| 2573105 | 5/1986 | France | 256/13.1 |
| 2589176 | 4/1987 | France | 256/13.1 |
| 2633319 | 12/1989 | France | 256/13.1 |
| 2658214 | 8/1991 | France | 256/13.1 |
| 2663968 | 1/1992 | France | 256/13.1 |
| WO93/07340 | 4/1993 | WIPO | 256/13.1 |

*Primary Examiner*—Edward K. Look
*Assistant Examiner*—Michael S. Lee
*Attorney, Agent, or Firm*—Steinberg, Raskin & Davidson

[57] ABSTRACT

Composite slip rails for road safety made from round wooden bars reinforced with iron and comprising posts made from sectional iron and supporting each one a spacer carrying a horizontal guard rail consisting of previously slotted round wooden beams reinforced with embedded metal fishplates providing for the cohesion of the wood and the connection of the elements.

11 Claims, 4 Drawing Sheets

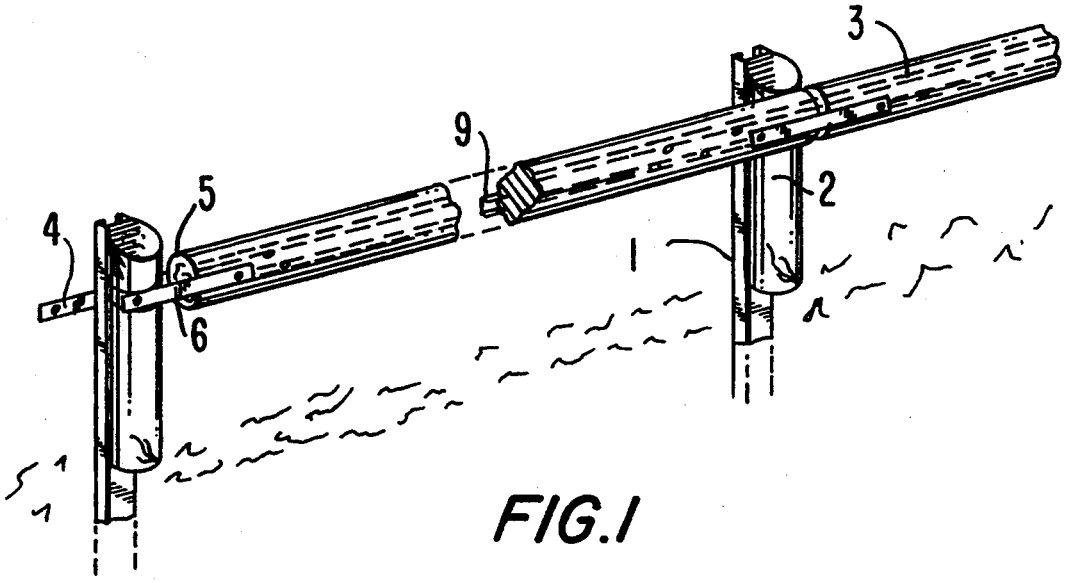
FIG.1
FIG.2A
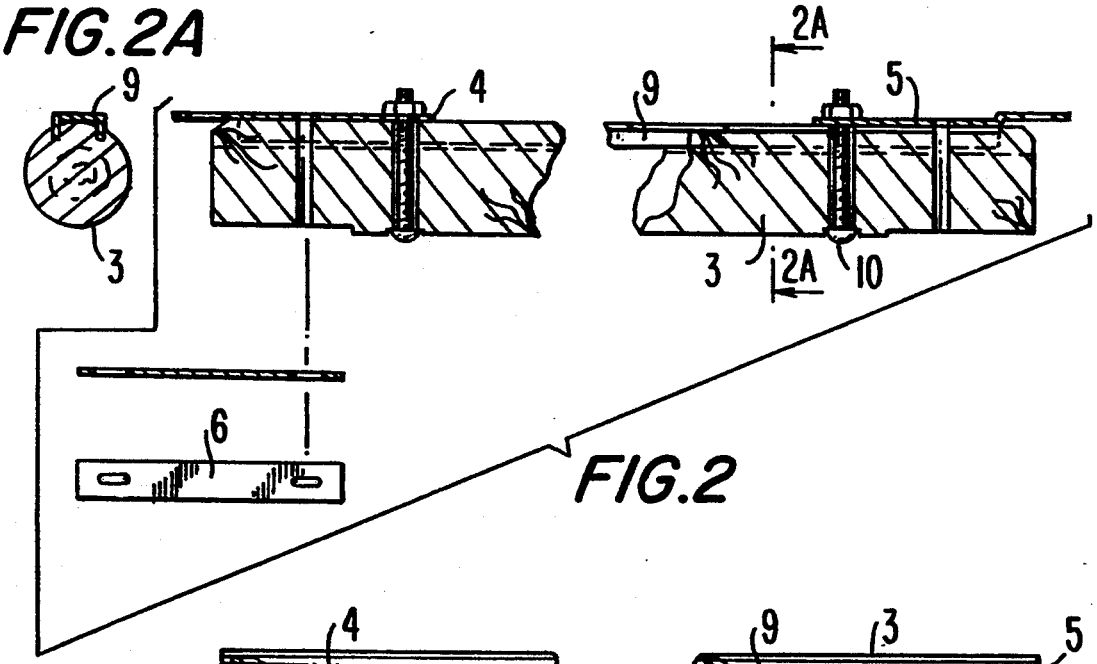
FIG.2
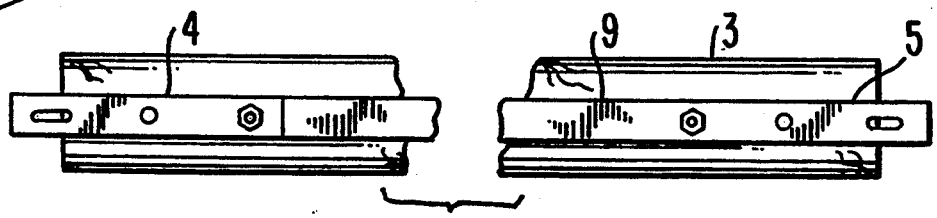
FIG.2B

COMPOSITE ROAD SAFETY SLIP RAILS MADE FROM METAL AND REINFORCED WOOD

BACKGROUND OF THE INVENTION

The present invention relates to safety slip rails made from round or cylindrical wood adapted to be placed in all the places where vehicles are likely to move deliberately or accidentally away from the tracks or traffic lanes which are assigned to them, in particular along roads and motorways or turnpike roads or at the borders of car parks and parking lots. The technical field involved therefore is the one of the manufacture or building of road safety devices.

OBJECT AND SUMMARY OF THE INVENTION

A known system is disclosed in the French patent of invention publication No. 2,663,968.

The object of the present invention is the provision of guard rails made from round or cylindrical wooden beams or balks reinforced with embedded iron advantageously combining the complementary properties of these two materials, of iron-bound or hooped wooden spacers as well as a method of mounting and of manufacture which increases the reliability of the known systems and substantially decreases the manufacturing, transport and working costs. It adapts itself advantageously to all mounting situations: comers, hill tops, rail ends.

The problems to be solved are the following:

1. Wood is a heterogeneous natural material likely to exhibit points of lesser strength and under the shock of a vehicle, there is little bending but it may break. On the contrary the coefficient of friction between iron and wood is very great and this is a property usable with advantage for stopping the vehicles.
2. The metal supports or holders are unaesthetic or homely.
3. The metal supports should be spaced from the guard rail to avoid the shock with the vehicle. A spacer therefore is necessary.
4. With the known methods the mounting operations are difficult and make use of multiple parts. It is therefore necessary to simplify the mounting and to make it versatile.

To solve these problems, the following solutions have been found:

1. The guard rails are reinforced on their sides opposite from the road by a sectional iron embedded or set in the wooden guard rail. The flanges of the section are accommodated within two slots parallel to the center line axis of the guard rail and thus are invisible, i.e. hidden.
2. The spacer consists of a round or cylindrical wood arranged vertically between the metal support and the guard rail. In this manner the support is concealed but the spacer ends at 5 cm from the ground to avoid any risk of becoming rotted. For the same grounds the top end is cut slantwise or askew.
3. To avoid hindering or impeding the slipping of the vehicle along the slip rail, the spacer may rotate about the center line axis of the fastening bolt. The structure is reinforced with a galvanized metal hoop to avoid any risk of projection.
4. To facilitate the mounting, those metal fastening butt-straps or fishplates which are opposite from the road are made fast to an embedded sectional iron and mounted in the workshop or factory. All the butt-straps or fishplates are provided with elongated holes making the mounting possible in any situations whatsoever. If need be, the elements of the horizontal guard rail will have a length of two or four meters. They may also be mounted onto existing supports in replacement of metal safety slip rails without changing the support and possibly without changing the existing metal spacer.

The safety device according to the invention may be put in place with the equipment available in those enterprises which are usually laying or installing metal slip rails without any particular training of the staff.

The device comprises a limited number of standard parts:

- standard metal posts,
- wooden spacers according to the invention or standard metal spacers,
- guard rails according to the invention with a length of four meters for straight lines and corners or of two meters for special uses and sharp corners,
- fastening bolts with shouldered or collar nuts or with nuts and wide washers, e.g., commercial grade fasteners such as mushroom head bolts with square necks ("JAPY" bolts) having a diameter of 16 mm and a length of 200 mm (referred to as TRCC 16×200 type);
- short connecting butt-straps or fishplates towards the road side.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of nonlimiting example only, illustrating a presently preferred specific embodiment of the invention and in which:

FIG. 1 is a perspective view of the mounting of a safety slip rail according to the invention;

FIG. 2 shows an element of horizontal guard rail with a length of four meters with its characterizing features as well as the connecting fishplate;

FIG. 2A is a cross-sectional view taken along the line 2A—2A of FIG. 2.

FIG. 2B is a rear view of the construction shown in FIG. 2;

FIG. 3B is a perspective view of the iron ring which surrounds the spacer shown in FIG. 3;

DETAILED DESCRIPTION OF THE INVENTION

Figure 3:
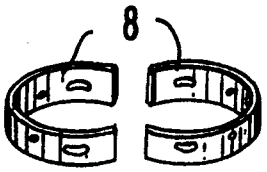
FIG. 3 shows a front view of the galvanized iron-bound or hooped wooden spacer (2)
Figure 3A:
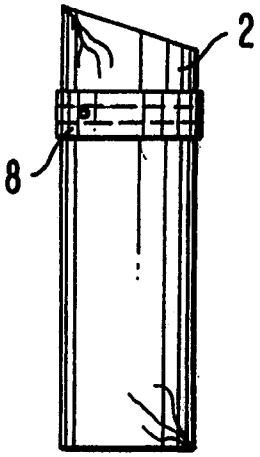
FIG. 3A is a side view of the constructions shown in FIG. 3.
Figure 3:
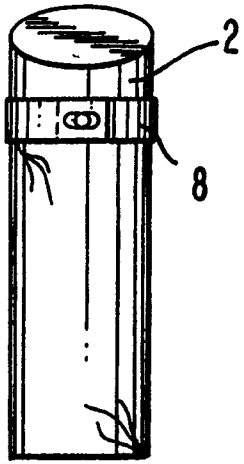

FIG. 1 is a perspective view of a slip rail section according to the invention which consists of galvanized iron posts or uprights (1) according to the models approved by the engineering road and motorway departments, carrying a pre-impregnated cylindrical wooden spacer hooped with galvanized iron and itself supporting a horizontal guard rail consisting of cylindrical reinforced wooden elements previously machined, pre-impregnated and previously mounted in the workshop or factory, which are assembled end to end by fishplates (4), (5),(6).

FIG. 2 shows the detail of each one of the standard elements of guard rails such as it leaves the manufacturing plant, ready to be mounted on the building site. Each one of the elements according to the invention consists of a wooden cylinder (3) grooved with two longitudinal slots which are housing in embedded relationship both flanges of a sectional iron (9) made fast as by welding to the fishplates (4) and (5). This metal assembly is secured to the wooden cylinder (3) by two bolts (10) advantageously mounted in the workshop. The width of the U-shaped section should be one third of the diameter of the guard rail. The dimensions of the components of the illustrated guide rail elements are as follows: the wooden cylinder or wooden billets 3 have a length of about 2 meters (1980 mm) or about 4 meters (3980 mm) and a diameter of 180 mm; the fishplates 4,5,6 have a width of 60 mm and the holes in the fishplates 4,5 through which the bolts 10 extend into the wooden billets 3 have a diameter of 18 mm; the diameter of the holes in the wooden billets is also 18 mm; the holes in the fishplate 6 are elongated and have a width of 18 mm and a length of 40 mm and the centers thereof are spaced 320 mm from each other; and the total length of the fishplate 6 is 420 mm.

FIG. 3 shows the detail of each one of the spacers (2) consisting of a vertical wooden cylinder cut at its top part according to a bevel shape in order to allow rain water to flow off and hooped or bound with a galvanized iron ring 8. During mounting, the tightening or clamping effect of this collar will reinforce the cohesion of the wooden cylinder and avoid the projections in case of bursting or splintering under an impact. The height is designed according to the invention to avoid the contact with the ground. The dimensions of the illustrated spacer 2 and iron ring 8 are as follows: the height of the spacer is a maximum of 660 mm decreasing to 610 mm as a result of the bevel; the diameter of the spacer 2 is 180 mm; the holes in the iron ring 8 have a diameter of 20 mm and the width of the iron ring is 60 mm; and the distance between the bottom of the spacer 2 and the center of the holes in the rings 9 is 520 mm.

All the wooden parts are processed after having been machined and prior to the mounting by injections of salts of the CCA type, class 4 according to the French standard NF B 50-100 (equivalent to injections of a composition comprising a mixture of copper oxide (CuO), chromic oxide ($CrO_3$) and arsenic pentoxide ($As_2O_5$), manufactured and sold by the British firm RENTOKIL).

Figure 4:
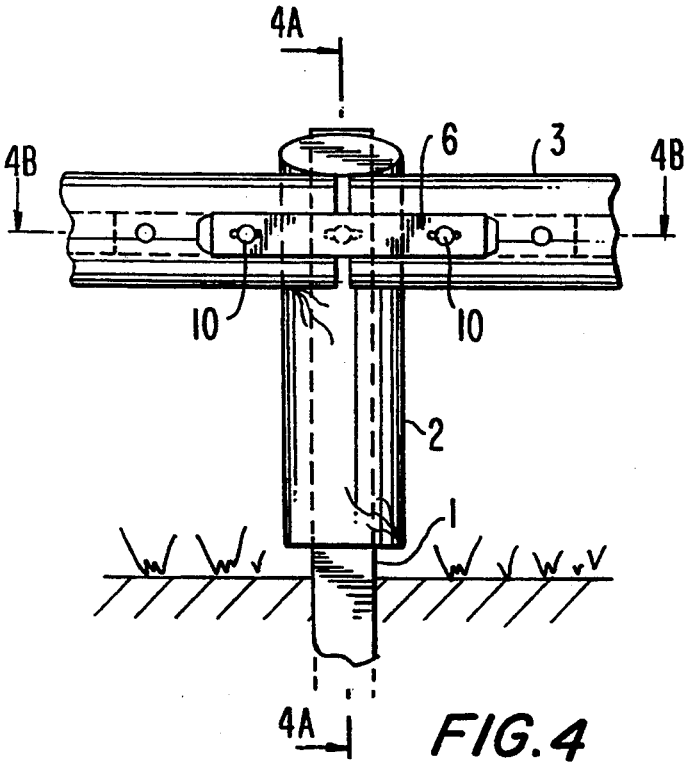
FIG. 4 shows a front view of the mounting of a guard rail (3) and of the spacer (2) onto the support (1)
Figure 4A:
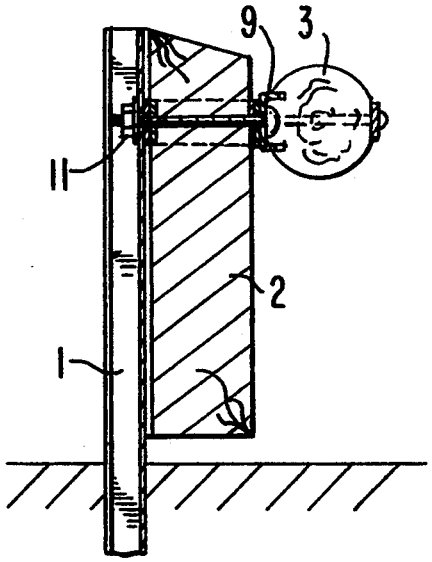
FIG. 4A is a cross-sectional view taken along the line 4A—4A of FIG. 4.
Figure 4B:
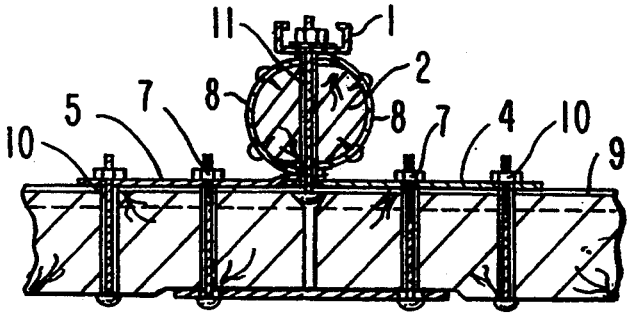
FIG. 4B is a cross-sectional view taken along the line 4B—4B of FIG. 4.

Each one of the guard rail elements thus described should be made fast to the following one, to the support 1 and to the spacer 2 according to the mounting depicted on FIG. 4 by bolts 7, 10 and 11 with a diameter of 16 mm. The elongated holes in the fishplates 4, 5 and 6 depicted on FIG. 2 allow the adjustments according to the ground, according to the curves or bends of the read and according to the positions of the metal supports.

Figure 5:
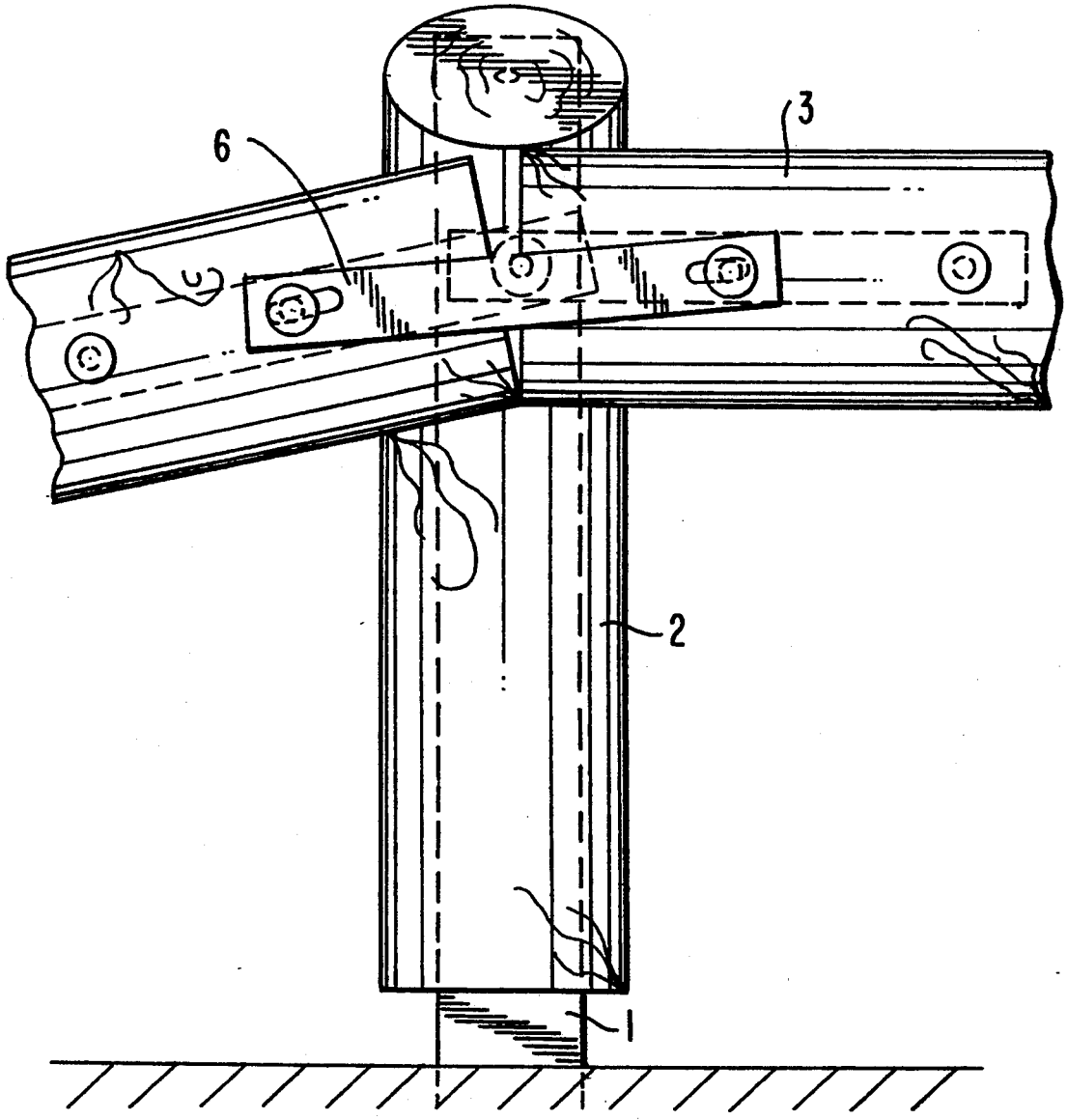
FIG. 5 shows the mounting of one safety slip rail end with one end driven into the ground.

The possible rotation about the axis of connection 11 constituted by the bolt assembling the support 1, the spacer 2, the fishplate 4 of a horizontal guard rail element and the fishplate 5 of the next element advantageously allows the provision of the slip rail ends without any modification according to the description which has been made thereof with reference to FIG. 5.

What is claimed is:

1. A composite wooden-metal safety slip rail comprising at least one horizontal guide rail fastened to a metal support, said at least one guide rail consisting of cylindrical round wooden billets assembled end to end by fishplates which are connected to each other by bolts which extend through said fishplates and ends of said billets in a horizontal diametral plane of said billets, wherein the improvement consists in that said billets are reinforced on a rear side face by a U-shaped section embedded into said billets and are spaced from said metal support by a spacer consisting of a wooden cylinder.

2. A safety slip rail according to claim 1, wherein said U-shaped section is embedded in said billets over a width equal to one third of the diameter of said billets to provide for diametral and longitudinal cohesion of the wood.

3. A safety slip rail according to claim 1, wherein the connecting fishplates are made fast to the U-shaped section by welding and made fast to said billets by a plurality of bolts.

4. A wooden safety slip rail according to claim 1, further comprising elongated holes in said fishplates, one of said bolts providing a connecting axis between a respective one of said billets and said metal support to enable rotation of said respective one of said billets for the mounting of the slip rails with their ends buried into the ground.

5. A safety slip rail according to claim 1, wherein said wooden cylinder of said spacer is hooped with a galvanized iron ring, further comprising an additional bolt extending through said iron ring for connecting said wooden billets through said fishplates to said metal support.

6. A composite safety slip rail comprising at least one horizontal guide rail fastened to a metal support system, said at least one guide rail comprising a plurality of elongate wooden billets, fishplates for connecting ends of adjacent ones of said billets, fastening means for connecting said fishplates to said billets, the improvement comprising a U-shaped section embedded into a rear face of said billets for reinforcing said billets, and retaining means for retaining said billets at a distance from said metal support system.

7. The safety slip rail of claim 6, wherein said fastening means comprise bolts extending through apertures in said fishplates and apertures in said billets.

8. The safety slip rail of claim 6, wherein one of said fishplates is fixed on said rear face at each end of said billets to said U-shaped section.

9. The safety slip rail of claim 8, wherein said retaining means comprise a wooden cylinder intermediate to said metal support system and said wooden billets, said wooden cylinder having an aperture therein, and a bolt extending through said metal support system, said aperture in said wooden cylinder and apertures in said fishplates arranged on said rear face of said billets.

10. The safety slip rail of claim 8, wherein an additional one of said fishplates connects a pair of adjacent ones of said billets at a front face of said billets, said additional fishplate comprising elongated holes.

11. The safety slip rail of claim 10, wherein said fastening means comprise bolts extending through said elongated holes in said additional fishplate and said billets, said bolts providing a connecting axis to enable rotation of said pair of adjacent billets relative to one another.

* * * * *